US009103047B2

(12) United States Patent
Byrd et al.

(10) Patent No.: US 9,103,047 B2
(45) **Date of Patent: *Aug. 11, 2015**

(54) ELECTROCHEMICAL DEPOSITION PROCESS FOR COMPOSITE STRUCTURES

(75) Inventors: Norman R. Byrd, Villa Park, CA (US); Steven G. Keener, Trabuco Canyon, CA (US); Stephen C. Amundson, Huntington Beach, CA (US); Arthur Rojo, Cypress, CA (US)

(73) Assignee: The Boeing Company, Chicago, IL (US)

( * ) Notice: Subject to any disclaimer, the term of this patent is extended or adjusted under 35 U.S.C. 154(b) by 1076 days.

This patent is subject to a terminal disclaimer.

(21) Appl. No.: 13/099,807

(22) Filed: May 3, 2011

(65) Prior Publication Data

US 2011/0266153 A1 Nov. 3, 2011

Related U.S. Application Data

(60) Division of application No. 11/042,265, filed on Jan. 25, 2005, now Pat. No. 7,959,783, which is a continuation-in-part of application No. 10/676,860, filed on Sep. 30, 2003, now Pat. No. 7,195,701.

(51) Int. Cl.

| | |
|---|---|
| ***C25D 9/00*** | (2006.01) |
| ***C25D 9/02*** | (2006.01) |
| ***C25D 19/00*** | (2006.01) |
| ***C25D 13/02*** | (2006.01) |
| ***C25D 9/06*** | (2006.01) |
| ***C25D 13/04*** | (2006.01) |

(52) U.S. Cl.
CPC *C25D 13/02* (2013.01); *C25D 9/02* (2013.01); *C25D 9/06* (2013.01); *C25D 13/04* (2013.01)

(58) Field of Classification Search
CPC ..... C25D 9/00; C25D 9/02; C25D 19/00
USPC ..... 205/316, 317
See application file for complete search history.

(56) References Cited

U.S. PATENT DOCUMENTS

| | | | |
|---|---|---|---|
| 3,926,761 | A | 12/1975 | Sera et al. |
| 4,180,442 | A | 12/1979 | Byrd |
| 4,272,346 | A | 6/1981 | Jakubowski et al. |

(Continued)

FOREIGN PATENT DOCUMENTS

| | | |
|---|---|---|
| CN | 1 306 104 A | 8/2001 |
| DE | 37 00 811 | 7/1988 |

(Continued)

OTHER PUBLICATIONS

Database WPI Section Ch, Week 200612 Derwent Publications Ltd., London, GB; AN 2002-011675 XP002390849 & CN 1 160 488C; Changchun Applied Chem Inst Chinese Acad; Aug. 4, 2004.

(Continued)

*Primary Examiner* — Zulmariam Mendez
(74) *Attorney, Agent, or Firm* — Alston & Bird LLP

(57) ABSTRACT

A method of improving the material properties of a composite by electrodepositing particular polymers, organic compounds or inorganic compounds onto electrically conductive fibrous substrates, whether individual fibers or as a fabric, to form composites of improved structural properties and having particular physical properties such as being ice phobic, fire resistant, or electrically conductive.

21 Claims, 8 Drawing Sheets

A = Supply spool of graphite fiber or cloth.
B = Graphite pulley used as electrode.
C = Teflon pulleys.
D = Coating bath.
E = Wash bath.
F = Heaters used to activate fiber and subsequently cure or dry fiber/resin composite.
G = Graphite cathode.

Schematic of Continuous Electrodeposition onto Graphite Fibers

(56) References Cited

U.S. PATENT DOCUMENTS

| | | | |
|---|---|---|---|
| 4,341,889 | A | 7/1982 | Deichert et al. |
| 4,405,427 | A | 9/1983 | Byrd |
| 4,480,088 | A | 10/1984 | Pike |
| 4,582,932 | A | 4/1986 | Byrd et al. |
| 4,588,838 | A | 5/1986 | Byrd |
| 4,614,696 | A | 9/1986 | Ito et al. |
| 4,659,444 | A | 4/1987 | Iwata et al. |
| 4,664,768 | A | 5/1987 | Scala et al. |
| 4,724,062 | A | 2/1988 | Naarmann et al. |
| 4,738,757 | A | 4/1988 | Naarmann |
| 4,739,115 | A | 4/1988 | Byrd et al. |
| 4,749,451 | A | 6/1988 | Naarmann |
| 5,126,017 | A | 6/1992 | Nakama et al. |
| 5,238,542 | A | 8/1993 | Bell et al. |
| 5,358,747 | A | 10/1994 | Balaba et al. |
| 5,844,053 | A | 12/1998 | Nishida |
| 6,033,545 | A | 3/2000 | Kaylo et al. |
| 6,537,654 | B1 | 3/2003 | Gruber et al. |
| 6,558,782 | B1 | 5/2003 | Bakman et al. |
| 6,565,971 | B2 | 5/2003 | Morita et al. |
| 6,569,523 | B2 | 5/2003 | Ikeda et al. |
| 6,575,726 | B1 | 6/2003 | Nissel |
| 6,576,341 | B1 | 6/2003 | Davey et al. |
| 6,609,452 | B1 | 8/2003 | McCormick et al. |
| 6,627,312 | B1 | 9/2003 | Behr et al. |
| 6,630,221 | B1 | 10/2003 | Wong |
| 6,630,416 | B1 | 10/2003 | Lam et al. |
| 6,638,615 | B2 | 10/2003 | Kobayashi et al. |
| 6,649,265 | B1 | 11/2003 | Kawamura et al. |
| 6,660,383 | B2 | 12/2003 | Toyoda et al. |
| 6,686,048 | B1 | 2/2004 | Arimoto et al. |
| 6,689,439 | B2 | 2/2004 | Sobolewski |
| 6,699,582 | B2 | 3/2004 | Morita et al. |
| 6,699,589 | B2 | 3/2004 | Woydt et al. |
| 6,797,795 | B2 | 9/2004 | Byrd |
| 6,809,169 | B2 | 10/2004 | Byrd et al. |
| 7,854,788 | B2 | 12/2010 | Byrd et al. |
| 2003/0235696 | A1 | 12/2003 | Byrd |
| 2004/0037951 | A1 | 2/2004 | Hempelmann et al. |
| 2004/0091711 | A1 | 5/2004 | Mukasa et al. |
| 2005/0161337 | A1 | 7/2005 | Byrd et al. |

FOREIGN PATENT DOCUMENTS

| | | | |
|---|---|---|---|
| EP | 0 374 680 | | 6/1990 |
| GB | 1 205 852 | | 9/1970 |
| GB | 1 404 290 | | 8/1975 |
| JP | H02307967 | A | 12/1990 |
| WO | WO 2005/033373 | | 4/2005 |

OTHER PUBLICATIONS

PCT Search Report and Written Opinion for PCT/US2006/001610 dated Aug. 8, 2006.

Tsubokawa, N., et al.; "Surface Grafting of Polymers onto Carbon Thin Film", Journal of Applied Polymer Science; vol. 58; Issue 8; Nov. 21, 1995; pp. 1221-1227.

Delamar, M., et al.; "Modification of Carbon Fiber Surfaces by Electrochemical Reduction of Aryl Diazonium Salts: Application to f Carbon Epoxy Composites"; Carbon Journal; vol. 35; Issue 6; 1997; pp. 801-807.

Reichenbacher, P. H., et al.; "Intermediates in Anodic Oxidation of Carboxylates. Chronopotentiometry"; Journal of the American Chemical Society;vol. 90; No. 13, Jun. 1968; pp. 3432-3436.

Andrieux et al.; "Derivatization of Carbon Surfaces by Anodic Oxidation of Arylacetates. Electrochemical Manipulation of the Grafted Films", Journal of the American Chemical Society; vol. 119; No. 18; May 7 1997; pp. 4292-4300.

Buttry, D. A., et al.; "Immobilization of amines at carbon fiber surfaces"; Carbon; vol. 37; Issue 12; 1999; pp. 1929-1940.

Miller, L. L., et al.; "Electrode Surface Modification via Polymer Adsorption"; Journal of the American Chemical Society, vol. 100; No. 2; Jan. 1978; pp. 639-640.

Downard, A. J.; "Electrochemically Assisted Covalent Modification of Carbon Electrodes"; Electroanalysis; vol. 12; No. 14; Oct. 2000; pp. 1085-1096.

Pierson, H. O.; "Applications of Carbon Fibers", Chapter 9 from Handbook of Carbon, Graphite, Diamond and Fullerenes—Properties, Processing and Applications; © 1993 by Noyes Publications; Park Ridge, New Jersey; US; pp. 198-225.

International Search Report and Written Opinion for U.S. Appl. No. PCT/US2004/033057 dated May 25, 2005.

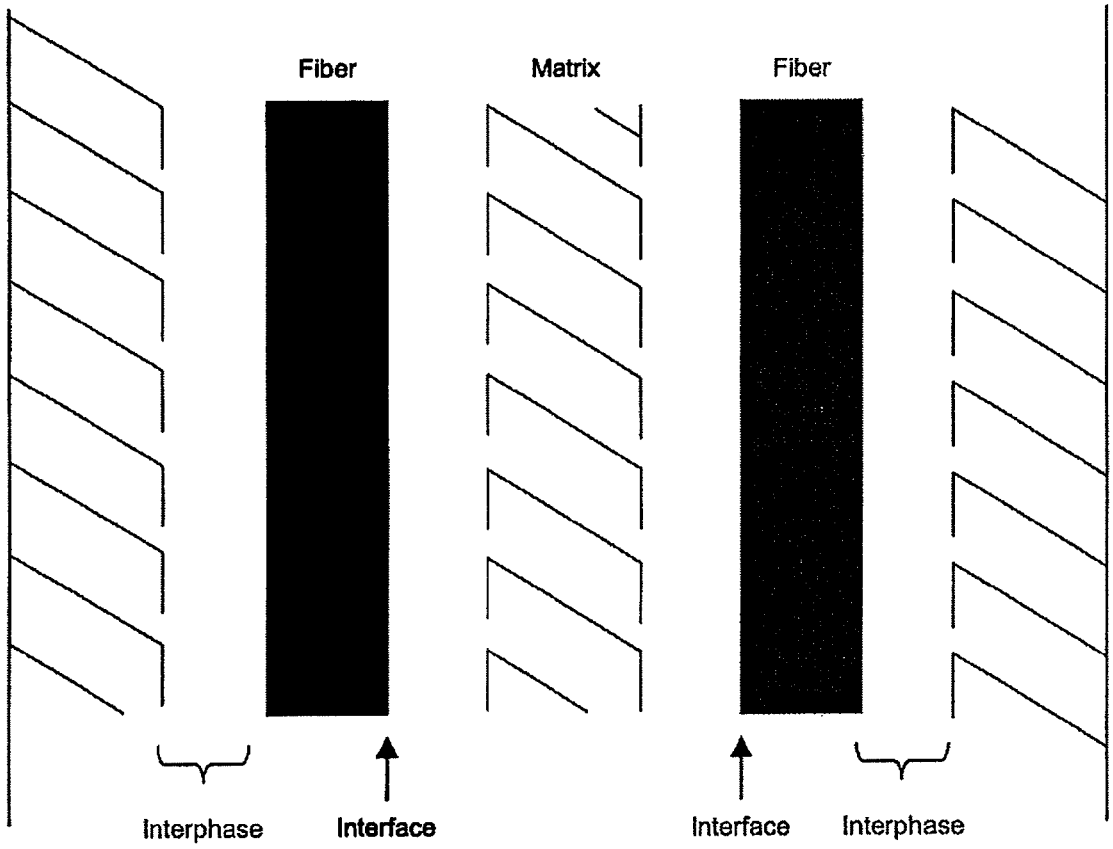
Figure 1. Fiber-Matrix Interface/Interphase in Fibrous Composite Material

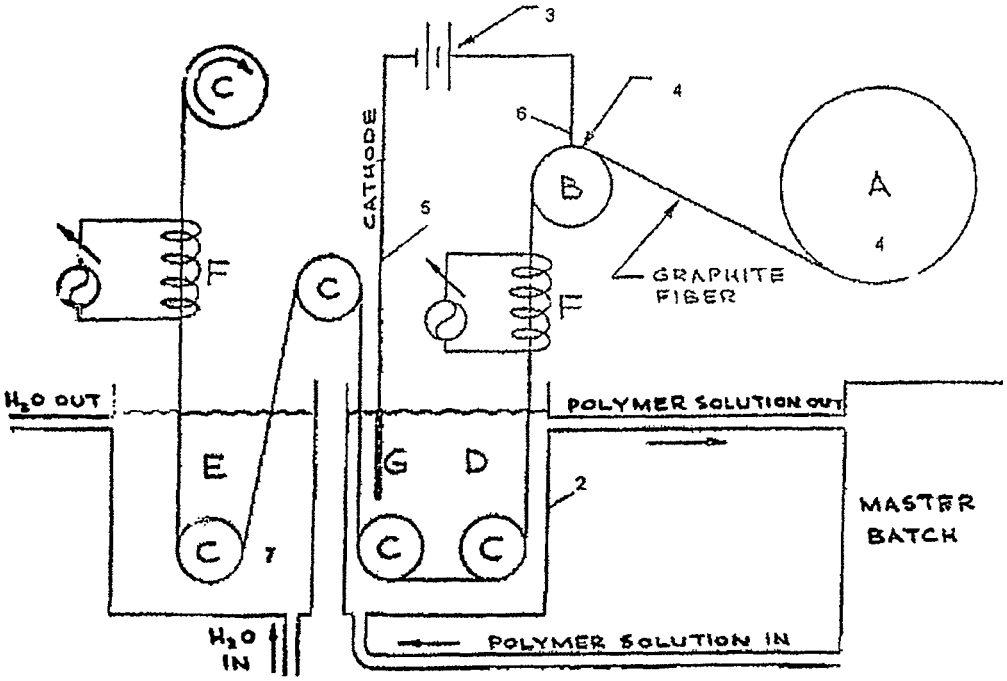
A = Supply spool of graphite fiber or cloth.
B = Graphite pulley used as electrode.
C = Teflon pulleys.
D = Coating bath.
E = Wash bath.
F = Heaters used to activate fiber and subsequently cure or dry fiber/resin composite.
G = Graphite cathode.
Figure 2. Schematic of Continuous Electrodeposition onto Graphite Fibers

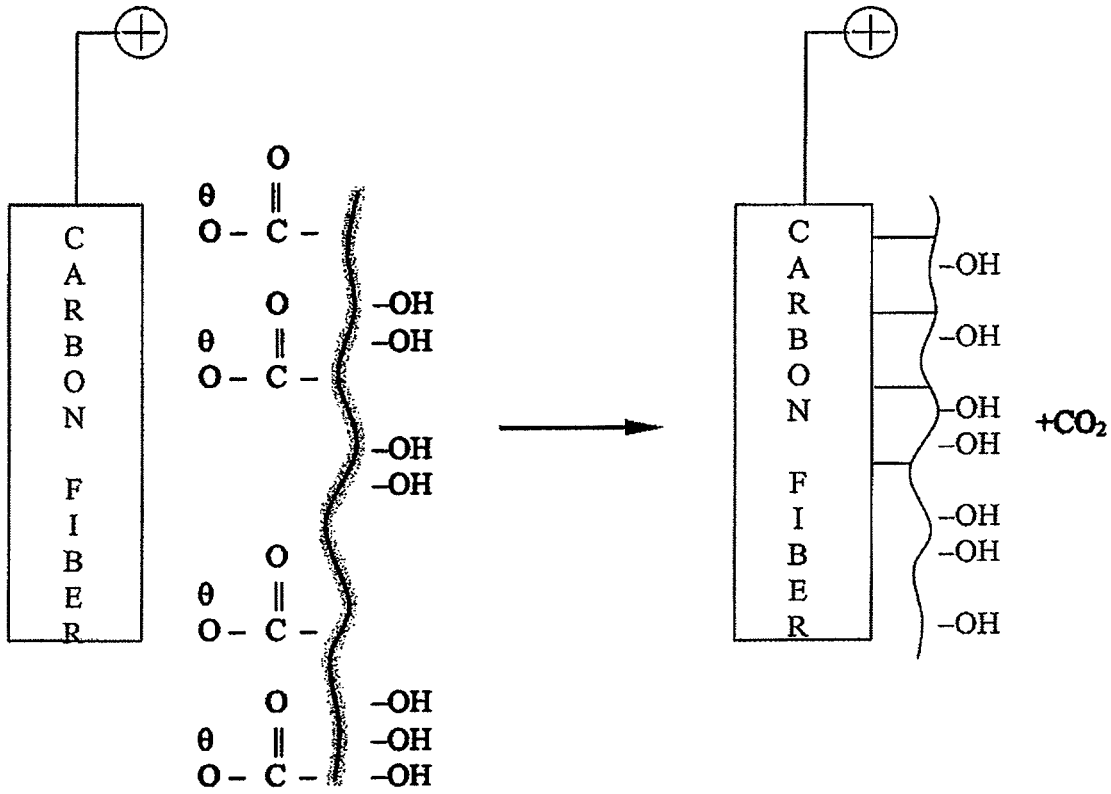
Figure 3. Electrodeposition of Carboxymethylcellulose Onto Carbon Fiber
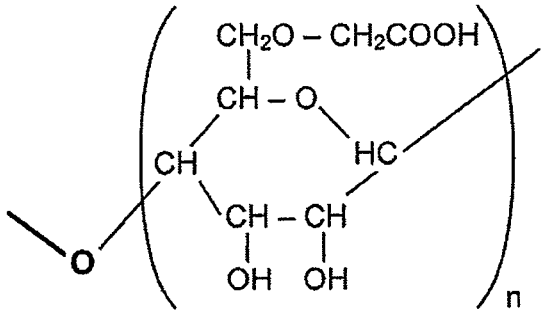
Figure 4. Carboxymethylcellulose

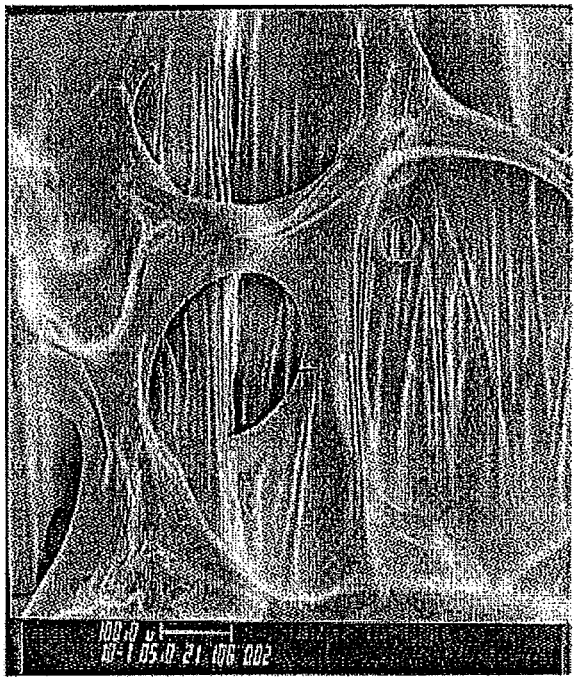
Figure 5. 100X of Electrodeposited CMC on Carbon Fibers
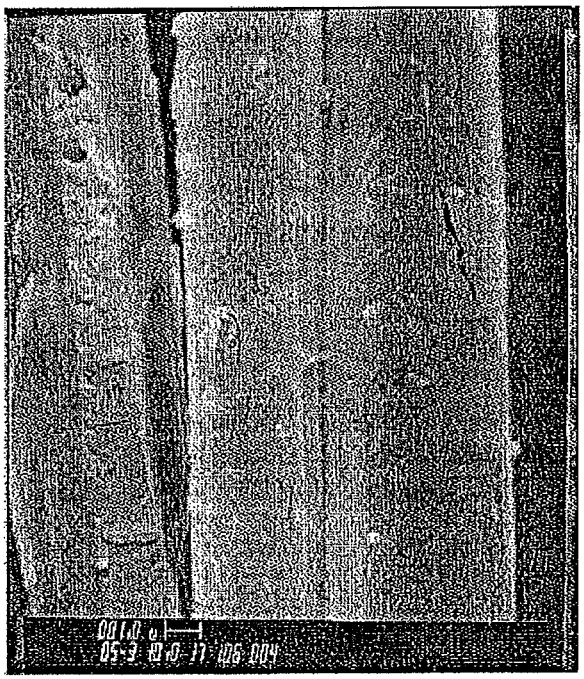
Figure 6. 5000X of Electrodeposited CMC and Washed With NaOH Solution

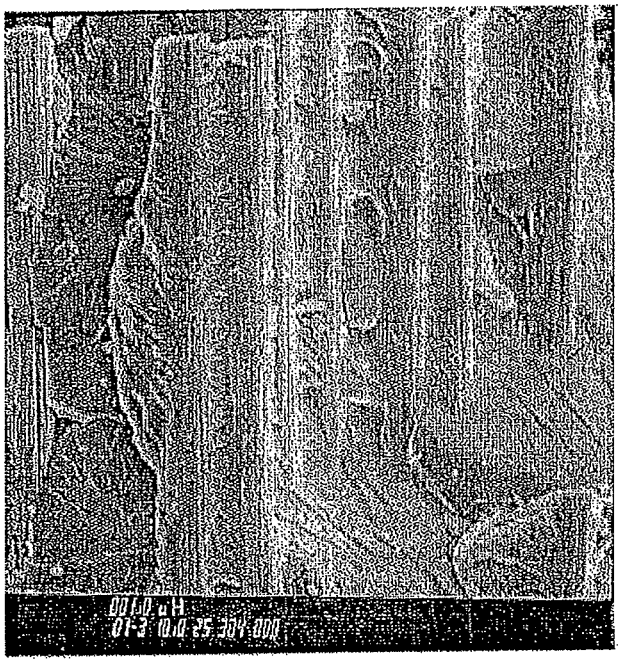
Figure 7. CMC Electrodeposited, Embedded in Epoxy and Fractured – 1000X
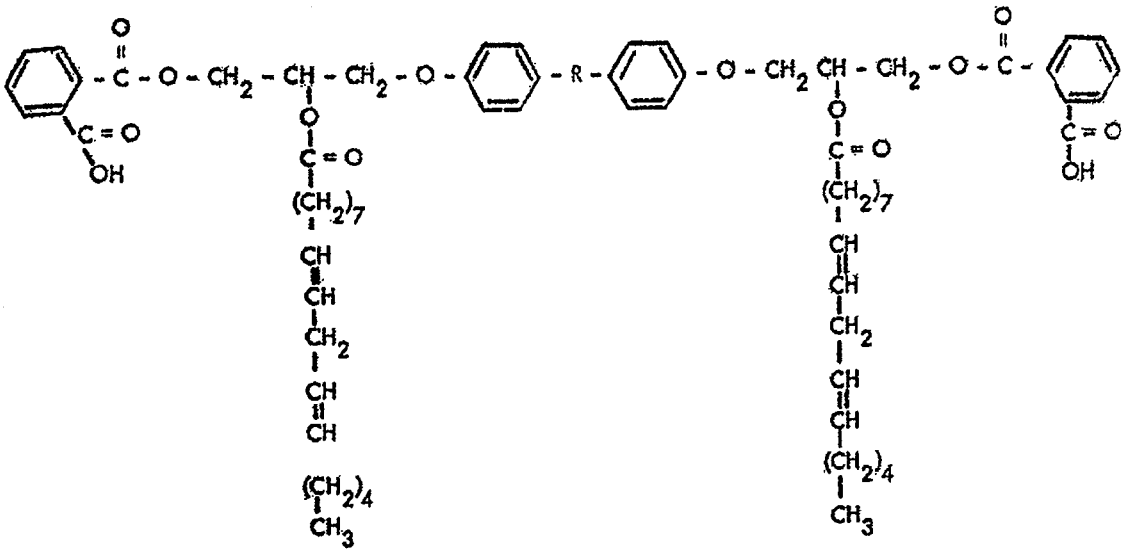
Figure 12. Generalized Structure of DX-16

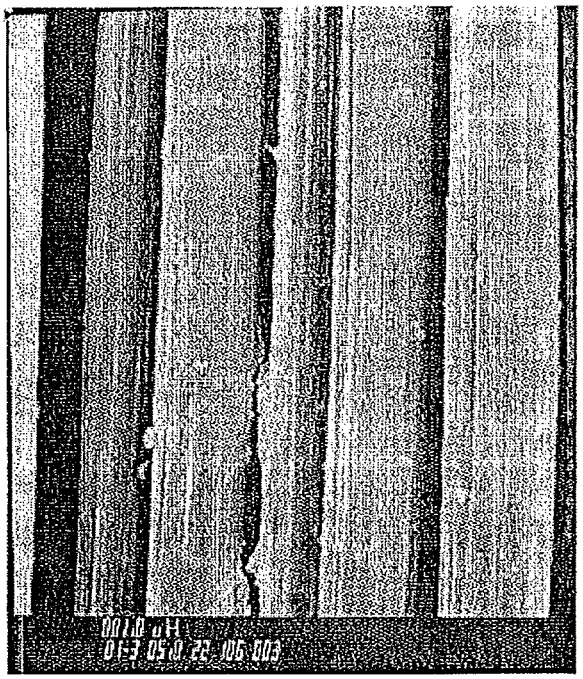
Figure 9. Styrene/Maleic Di-acid Electrodeposited on Unsized Fibers – 1000X
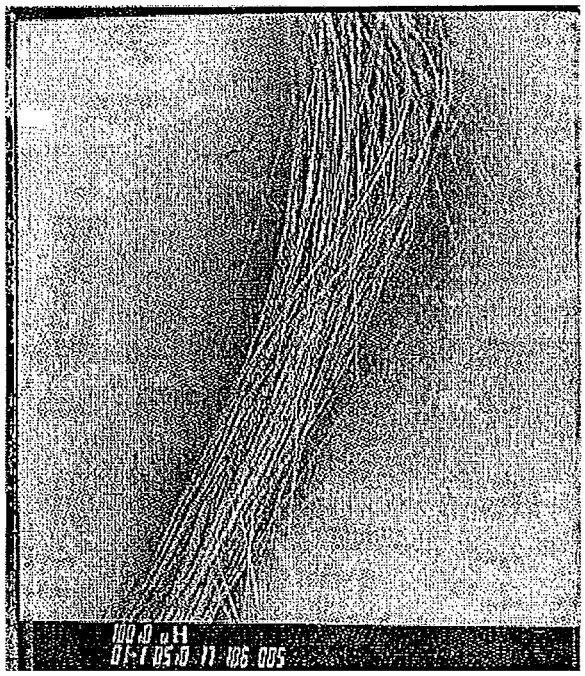
Figure 8. Styrene/Maleic Di-acid Electrodeposited on Unsized Fibers – 10X

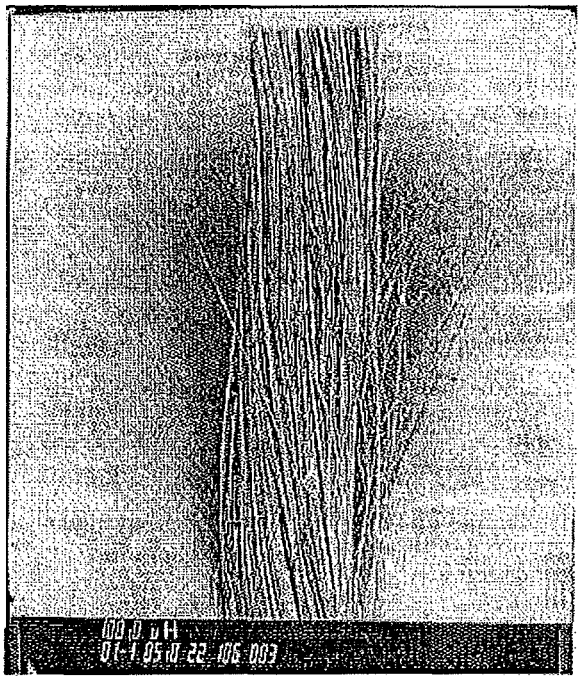
Figure 10. Caustic Treated Styrene/Maleic Di-acid Electrodeposited on Unsized Fibers – 10X
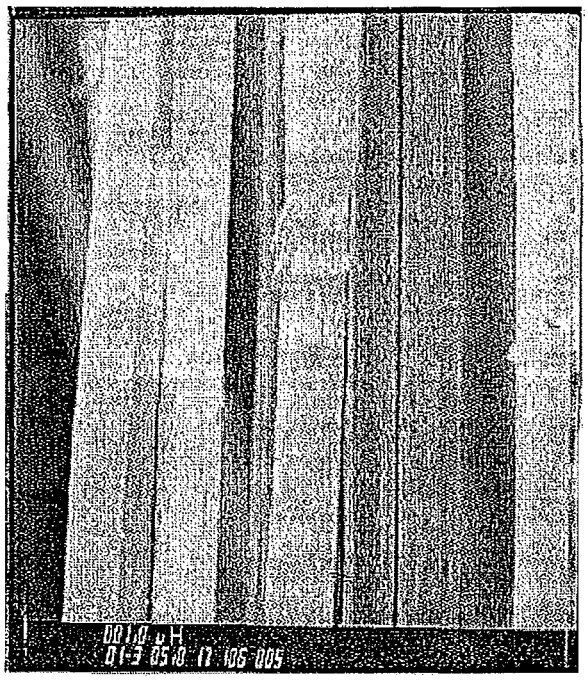
Figure 11. Caustic Treated Styrene Maleic Di-acid Electrodeposited on Unsized Fibers – 1000X

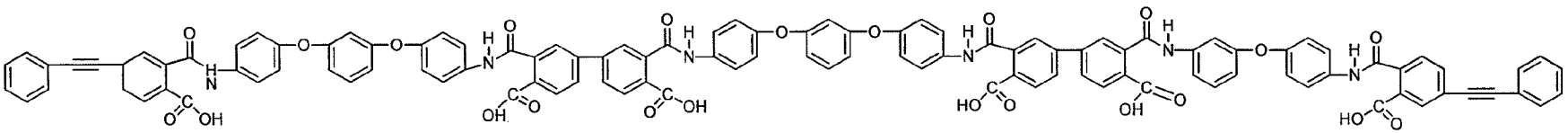
Figure 13. Polymatic Acid Precursor to PETI-298 Polyimide

ELECTROCHEMICAL DEPOSITION PROCESS FOR COMPOSITE STRUCTURES

CROSS-REFERENCE TO RELATED APPLICATIONS

This application is a divisional application and claims the benefit of U.S. patent application Ser. No. 11/042,265, filed Jan. 25, 2005, which is a continuation-in-part application that claims the benefit of U.S. Pat. No. 7,195,701 filed Sep. 30, 2003, both of which are hereby incorporated herein by reference.

FIELD OF THE INVENTION

This invention relates to electrochemical deposition of polymeric materials upon carbon substrates. More particularly, this invention relates to a process of forming resin impregnated carbon fiber composites using electrochemical deposition.

BACKGROUND OF THE INVENTION

Composite structures, in particular, carbon fiber/resin materials, are rapidly increasing in use, and are of particular interest to the aerospace industry where there is a need for high strength-to-weight structures. A similar need exists in the watercraft and automobile industry where high-strength/light-weight bodies and other structural parts are being used for possible weight reduction for increased fuel efficiency.

One favorable characteristic of carbon-resin composites is that the composite exhibits physical characteristics particular to the matrix resin. For example, if the resin has properties of high thermal resistivity or being fire retardant, then the composite made from that matrix resin will, to some extent, exhibit those properties as well. Thus, the particular resin chosen for each application is typically not chosen just for its structural properties, but also for whatever other desired characteristics might be best suited for the application.

Though composite structures typically exhibit improved structural properties in comparison to the resin itself, there are still many limitations in the formation of composite structures. One such limitation in composites is the physical bond that exists between the resin and the carbon fibers of the composite. In order for the composite to have any load-carrying capability, it is necessary for the resin to be in close proximity (usually mechanically locked) to the fiber. Thus, carbon-resin composite technology depends on the formation of a strong bond between a fiber substrate and a resin matrix; and the bond interaction parameters are analogous to those found in adhesive bonding processes.

The chemical bond between resin and fiber material, i.e. at the interface between the fiber and the matrix resin, is typically a limiting factor in the strength of a composite material. The "interface" is usually one molecular layer thick, i.e., nanolayer, and refers to the meeting of the resin material with the surface of the fiber; and all these are governed by the interactions that occur in the nano (monomolecular) layer of the resin/fiber interface. In contrast, the "interphase" is of macroscopic dimensions and describes macroscopic qualities of the composite. It is the combination of the interface and interphase properties of the material that determines the behavior of a composite. Thus, it is the surface area and roughness of the reinforcement (fiber), the wetting properties of the matrix, and the differences in thermal and mechanical properties of the constituents that are strongly involved in determining the interaction, bonding and strength of a composite.

It is desired to produce a composite of improved strength where the resin material is intimately bonded to the surface of the composite fibers, thus forming strong interfacial bonds within the composite. It is further desired to produce a composite material having improved strength and interfacial bonding from a resin having desirable physical and chemical characteristic such that the resultant composite exhibits the physical/chemical characteristics of the resin.

SUMMARY OF THE INVENTION

This invention provides for a method of forming a composite having particular physical attributes by electrodepositing particular organic or inorganic polymers, or organic or inorganic compounds, collectively referred to as "ionizable moieties", onto an electrically conductive fibrous substrate, typically carbon or metallic, whether formed of individual fibers, or as a fabric of fibers, to chemically bond the ionizable moieties to the surfaces of the fibers at the nanomolecular layer. The conditions for electrodeposition are maintained after deposition of the nanomolecular layer until additional layers, i.e. at least one additional layer, of the ionizable moieties form on top of the nanomolecular layer.

Use of resins having unique physical and chemical characteristics results in composites having those same desirable physical/chemical characteristics, i.e. ice phobic, fire resistant, electrically conductive, etc. Electrodeposition forms a unique discrete interface at the molecular layer between the substrate fibers and the matrix resin as opposed to any previous resin infusion process. The electrodeposition process allows for the optimization of chemical and physical properties of composite materials by increasing the bond strength between the substrate fibers and the matrix resin thereby improving the strength of the composite over otherwise similar non-electrodeposited composites.

The process is performed by immersing the fibrous substrate in an aqueous solution of an organic compound or polymer, or inorganic compound or polymer having ionizable moieties in the structure of the compound to be electrodeposited.

Organic compounds/polymers advantageously comprise phosphorus-containing polyamic acid, polypyrrole, polyaniline, phenyl phosphinic acid, or poly isobutylene-alt-maleic acid. Inorganic compounds/polymers are advantageously polysiloxane polymers, such as polysiloxane(amide-ureide) polymers.

Other compounds or polymers which may be used by this process include, but are not limited to, polyphosphazenes, polymetallophosphazenes, polyborazines, phosphonicacid-methylene iminodiacetic acid, as examples of flame retardant materials, polypyrrole, polyaniline, polyferrocene or polymetallocenes for use as electrically-conducting substances for lightning strike protection; polysulfones, polyquinoxalines, polyamic acids (to be converted to polyimides) or polyether ether ketones (PEEK) for use as high temperature resins; sol-gel type materials, as represented by triethoxyaminopropylsilanes for use as coupling agents for epoxies or polyamic acids. These substances, as such, or modified by introducing acidic moieties into the polymer may be used.

The electrodeposition is performed in an electrolysis cell where the fibrous substrate acts as the anode, where another electrode in contact with the aqueous solution of ionizable moieties acts as a cathode, and where the application of an electric potential causes the negatively ionizable moiety in solution to migrate to the anode to create a fiber-carbon or fiber-inorganic moiety bond somewhat analogous to the Kolbe reaction. In this reaction, a free radical results from the ionizable moiety which couples with the free electron in the charged electrode. When an organic or inorganic material is electrodeposited onto the fibrous substrate there is both a change in the interface and the type of bond that exists between the fiber and the organic/inorganic moiety. Moreover, in the first electrodeposited layer which is a monomolecular (nano) layer, a true chemical bond exists of about 80 kcal/mole. This in effect creates a new type of fiber.

This new fiber has different chemical and physical properties from the original fiber. This fiber can now be used to form different composites that would not have been possible with the original fiber. Additionally, almost any other resin or ionizable organic or inorganic compound can be electrodeposited until there is a large drop in current which indicates a monomolecular layer of resin has been deposited on the fiber and chemically bonded thereto.

When forming the composite, the conditions for electrodeposition may be maintained until substantially all (less than 5% free space within the composite) of the void spaces between fibers have been filled by deposited material. Alternatively, the conditions for electrodeposition may be continued until material is deposited upon the fibers to an intermediate point, and the fibers may be subjected to traditional resin impregnation techniques in order to complete the matrix around the fibers and to form the composite structure. Traditional resin impregnation techniques include, but are not limited to, resin infusion techniques of simply forcing a resin material into the fibrous substrate. Subsequent to the electrodeposition, depending on the type of substance deposited onto the fibrous substrate, the requisite curing process normally used for the resin being considered may also be used to effect a cure for the composite structure obtained after the electro-deposition process.

The present method differs from prior electrodeposition methods, in part, because compounds/polymers are selected for use based on the known physical properties of the compounds/polymers and the desired physical properties of the resulting composite. By way of example, polysiloxane (amide-ureides) may be used to impart ice-phobic/anti-icing characteristics to the composite. For instance, the following examples illustrate the use of various compositions in making the composite. The particular polysiloxanes (amide-ureide) of U.S. Pat. Nos. 6,797,795 and 6,809,169, incorporated herein by reference to the extent they do not contradict the instant disclosure, have been shown to have excellent ice-phobic properties and impart those properties to a composite when electrodeposited as described herein.

Use of a phosphorus-containing polyamic acid to obtain a phosphorylated polyimide upon being electrodeposited upon carbon fiber produces a composite having good thermal protection and is fire-resistant. Polyphosphinohydrazide

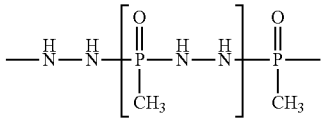

has been shown to have fire-resistant capability when electrodeposited onto carbon fiber that is subsequently made into a composite by impregnating a polyamic acid that is subsequently converted into a polyimide that contains the electrodeposited polyphosphinohydrazide. When subjected to a high temperature flame, it is slow to ignite and is self-extinguishing immediately after removal from the flame. Polypyrrole and polyaniline are electrically conductive polymers that produce a composite having lightning strike resistance.

With the electrodeposition, the process is controlled by time and voltage or amperage. Furthermore, the monomolecular layer of organic (or inorganic) compound resin may also function as a sizing that will protect the fiber from fraying or fuzzing. Thus, this process has a two-fold application. The present invention is a solution and a safe new material process application by modifying different resin compositions to create stronger covalent bonding in composite materials.

Other features and advantages of the present invention will be apparent from the following description in which the preferred embodiments have been set forth and in conjunction with the accompanying drawings.

BRIEF DESCRIPTION OF THE DRAWINGS

Having thus described the invention in general terms, reference will now be made to the accompanying drawings, which are not necessarily drawn to scale, and wherein:

FIG. 1 shows a fiber-matrix interface/interphase in fibrous composite material;

FIG. 2 shows a schematic of a continuous electrodeposition;

FIG. 3 shows electrodeposition chemical bonding of Carboxymethylcellulose (CMC) onto fiber;

FIG. 4 shows chemical formula for Carboxymethylcellulose;

FIG. 5 shows electrodeposited CMC on fiber at 100× magnification;

FIG. 6 shows electrodeposited CMC on fiber at 5000× magnification and washed in a NaOH solution;

FIG. 7 shows electrodeposited CMC on fiber at 1000× magnification embedded in epoxy and fractured;

FIG. 8 shows Styrene/Maleic Di-acid electrodeposited on unsized fibers at 10× magnification;

FIG. 9 shows Styrene/Maleic Di-acid electrodeposited on unsized fibers at 1000× magnification;

FIG. 10 shows caustic treated Styrene/Maleic Di-acid electrodeposited on unsized fibers at 10× magnification;

FIG. 11 shows caustic treated Styrene/Maleic Di-acid electrodeposited on unsized fibers at 1000× magnification;

FIG. 12 shows a generalized structure of DX-16; and,

FIG. 13 shows Polyamic Acid Precursor to PETI-298 Polyimide.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

In the case of electrodeposition onto a carbon fiber with an organic polymer, the polymer and carbon fiber are both carbonaceous. Therefore, once the process is initiated, the chemistry is allowed to progress through the intermediate stages. The result is a true covalent bond. The bond energies between atoms would be on the order of about 80-100 Kcal/g-mole, with bond distances being about 1-3 Å, i.e., monomolecular or nanolayer. This leads to theoretical bond strengths of about $10^6$ to $10^7$ lb./sq. in.

In the case of inorganic moiety, such as Si—OH, P—OH or P—NH, the bond that forms from the ionization of the —OH or —NH also results in a —C—OSi, —C—O—P, or —C—N—P structure with the consequent bond energies attributable to the corresponding —C—O—Si or —C—O—P or —C—N—P bonds. This process has already been demonstrated for an aluminum substrate wherein a polyphosphinohydrazide or a polyphosphinoguanide was electrodeposited as a coating onto aluminum and wherein the resultant product showed good corrosion resistance (U.S. Pat. No. 4,588,838, May 13, 1986).

The covalent bond is a true sharing of the electron orbitals such that the outer shell electrons of each contributing specie to the bond loses its identity and forms molecular orbitals that bind the nuclei of the interacting atoms. This manifests itself as a high electron density along the internuclear axis, and it is this type of bonding that would be expected to occur in the electrodeposition of an organic compound/polymer onto the carbon fiber with a bond energy of about 80-100 Kcal/g-mole. Based upon the chemistry of the Kolbe reaction, a carboxylate ion (RCOO ) or any other anion, e.g., RO, RSOO, $RSO_2O$, $RPO_3$, RSiO or RS, will give up an electron to the positively-charged anode to form a carboxylate (RCOO.), RO., RSOO., $RSO_2O$., $RPO_3$., RSiO. or RS. radical. In the case of a carboxylate radical, $CO_2$ is split out to leave an alkyl or aryl radical (R.), where R is any alkyl, aryl, cycloalkyl or heterocyclic radical. This radical will chemically attach to the carbon fiber and form a true carbon-carbon covalent bond. Similarly, the RO., RSOO., $RSO_3$., $RPO_3$. or RS. will also attach to the fiber. The RO. or RS. can split out $O_2$ or $S_2$ and form a carbon-carbon bond. In the case of RSOO., $RSO_3$., $RPO_3$., or RSiO., $O_2$ can split out and form a carbon-phosphorous, a carbon-sulfur, or a carbon-silicon bond. This will result in a nanolayer of organic compound/polymer onto the carbon fiber, and, at this point, the organic layer is a resistance layer with no further chemical bonding possible. However, an electrostatic field still exists around the fiber and the charged anions in solution will continue to migrate and deposit onto the already-coated fiber and build up further layers of the coating until, at constant voltage, the layer is so thick that the field effect is lost and the current drops to zero. Thus, time and voltage can be the critical determining factors with regard to the formation of a nanolayer.

Referring to FIG. 2, according to one embodiment, a continuous process for electrodeposition is shown in which a polymer, e.g., polyamic acid, or ionizable organic compound is dissolved in an aqueous medium 1, contained in a glass or other non-conducting container 2, with electrodes inserted and connected to a direct current source 3, and a carbon fiber or cloth 4. The solution 1 and the carbon substrate 4 are combined in the glass container 2. A power lead 5 is attached to a cathode, such as a carbon rod, and the other lead 6 is attached to the carbon cloth or fiber 4 as the anode. Electric potential is applied to cause the ionized chemicals to flow to the anodic substrate and bond thereon. Finally, a water or alkaline solution rinse 7 is used to remove any excess chemicals from the substrate.

Essentially, the technique of electrodeposition, for organic or inorganic compounds, consists of using an electrically conductive fibrous substrate, typically graphite fibers, as one electrode (anode) in an electrolysis cell with the cathode being any metal or graphite substance, such as a rod, and the electrodeposition onto the fibrous substrate is via the Kolbe reaction. In the case of a carbon fiber and a polymeric acid, where there is a multiplicity of functional acidic groups along the polymer chain, the resin can bond to the fiber in a multiplicity of sites, as schematically shown in FIG. 3.

FIG. 3 shows the attachment of multiple sites to the carbon fiber using the ammonium salt of carboxymethylcellulose (CMC) (Hercules Powder Co.) as the polymer. FIG. 4 depicts the general formula for carboxymethylcellulose. Alternatively, sulfonic or sulfinic, phosphoric or phosphonic, mercaptyl or other anionic acidic specie could be used. Using carboxymethylcellulose (CMC) as a test polymer, it was electrodeposited onto carbon fiber and then washed with water (in which CMC is very soluble). It was then found that a large amount of resin remained attached to the fiber, as seen in FIG. 5, which is a scanning electron microscope (SEM), 100× picture of the treated fiber. Further analysis was done via Fourier Transform Infrared (FTIR) spectroscopy. It showed the presence of the cellulose hydroxyls. Subsequently, a sodium hydroxide wash was done and 5000×SEM picture (FIG. 6) shows almost everything removed, but the FTIR still showed the presence of the cellulose hydroxyls. By comparison, when the fiber was dipped into the CMC solution for the same period as the electrodeposition process (but without electrodeposition), and then subjected to an aqueous wash, there was absolutely no evidence of any CMC on the fiber. The SEM and FTIR looked the same as an untreated fiber.

Further tests were performed to show that this nanomolecular layer of resin does form a true chemical bond from the fiber to any resin matrix. For this, the fiber with CMC attached to it, after removing the bulk of the material, was bonded with an epoxy resin and an interlaminar shear test was run. The sample did not fail in shear, but in tension. This indicated that a strong bond existed between the fiber and the resin. Another test that was run was to have the CMC-coated fiber, after removing the bulk of the material, embedded in an epoxy resin, cured, and then fractured in liquid nitrogen. FIG. 7 is a 1000×SEM picture of the composite after being fractured. Similar results were obtained when the CMC-coated fiber was first treated with either succinic anhydride or maleic anhydride and then embedded in an epoxy resin. In these instances, the fractured samples also showed that the epoxy was bonded to the anhydride-treated CMC fiber and that the matrix held onto the fiber, while for a non-electrodeposited sample there was separation between the fiber and the matrix.

In one embodiment of the invention, a polysiloxane (amide-ureide) of compound Ia is supplied. This compound, described in U.S. Pat. No. 6,797,795, issued Sep. 28, 2004, has been determined to have favorable anti-icing/de-icing properties.

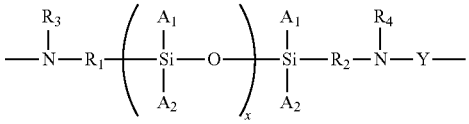

(Ia)

wherein for each repeat unit of the polymer, $R_1$ and $R_2$ are independently selected from the group consisting of $C_1$ to $C_{10}$ alkyls, aryls, and polyaryls; for each repeat unit of the polymer, $R_3$ and $R_4$ are independently selected from the group consisting of hydrogen, $C_1$ to $C_6$ alkyls, aryls, $C_3$ to $C_6$ cycloaliphatics, and $C_3$ to $C_6$ heterocycles; for each repeat unit of the polymer, $A_1$ and $A_2$ are independently selected from the group consisting of hydrogen, $C_1$ to $C_6$ alkyls, aryls, polyaryls, $C_3$ to $C_6$ cycloaliphatics, and $C_3$ to $C_6$ heterocycles; for each repeat unit of the polymer, x is a number from 1 to 1000; for each repeat unit of the polymer, Y is selected from a dicarboxyl residue and a non-linear diisocyanate residue, and wherein the polymer comprises at least one repeat unit where Y is a dicarboxyl residue and at least one repeat unit where Y is a nonlinear diisocyanate residue. The compound is dissolved in water and neutralized with an amine, e.g., ammonium hydroxide, triethylamine, pyridine, piperidine or other aliphatic, cycloaliphatics, heterocyclic or aromatic amine. Into this solution is immersed a conducting material, e.g., carbon fiber or metallic substrate. The container or another electrode is made the cathode and the immersed material is the anode in an electrolytic cell. A direct current potential is applied and the anodic material is coated with Ia. This material is subsequently either cured into a structural part or treated with another resin and then cured. The composite structure formed thereby is capable of being a structural part that exhibits ice-phobic properties.

In another instance, a polyphosphinohydrazide, as described in U.S. Pat. No. 4,582,932, Apr. 15, 1986, was prepared for use in the electrodeposition process for use as a fire retardant. Three moles of hydrazine hydrate was added to two moles of dimethylmethylphosphonate (DMMP) (or dimethylphosphite (DMPH))

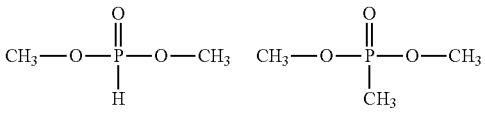

DMPH DMMP to result in an amine-terminated polymer. This was subsequently treated with succinic anhydride or maleic anhydride (or another acid anhydride) to obtain a carboxyl-terminated polyphosphinohydrazide which was then used in the electrodeposition onto the fibrous substrate. Alternatively, the polyphosphinohydrazide was used, as is, for the electrodeposition. After electrodepositing the polyphosphinohydrazide onto graphite fiber cloth and further impregnating with a polyamic acid, e.g., Peti298 (supplied by Eikos chemical Co., Franklin, Mass.) (shown in FIG. 13) and cured into a composite strip, the resultant polyimide/polyphosphinohydrazide combination was placed in the flame of Meeker burner, adjusted for 1000° F. temperature. A control sample of the polyimide (with no polyphosphinohydrazide) ignited easily and extinguished a short time later after removal from the flame. The sample containing the polyphosphinohydrazide took longer to ignite, but extinguished instantly upon removal from the flame.

The composite materials of the invention have favorable physical (non-structural) and structural properties not found in previous composite materials. First, by using particularly selected ionizable moieties to form the matrix resin of the composite, special physical properties of those ionizable moieties translate into similar physical properties for the composite formed therefrom. For instance, if a material formed from the ionizable moieties would otherwise have special physical properties, such as being ice-phobic, fire-resistant, electrically conductive, etc., then the composite formed from electrodeposition of the ionizable moieties also exhibits those special physical properties.

Second, by electrodepositing the ionizable moieties upon the carbon fibers to form the composite rather than simply impregnating the ionizable moieties as a resin matrix around the fibers, a composite of improved structural properties is formed. The improved structural properties are due to the chemical bonding that occurs at the interface of the fiber and resin material.

The composites of this invention are particularly useful in the formation of composite bolts, rivets, and other fasteners for industrial use.

The examples below demonstrate how the invented method is carried out in practice and demonstrate electrodeposition using a variety of organic/inorganic compounds/polymers.

EXAMPLES

Example 1

Electrodeposition of Carboxymethylcellulose

A 15 percent solution of carboxymethylcellulose (CMC) is prepared by dissolving 15 grams of CMC (0.07 moles) in 85 mls of deionized water in a stainless steel container. To this is added 0.07 moles of 28 percent ammonium hydroxide (8.7 grams). With the carbon fiber onto which the CMC will be electrodeposited as the anode in an electrolytic cell and the stainless steel container as the cathode, the electrolysis is begun by adjusting the d.c. voltage and measuring the drop in current (amperes) with time. When the amperes are close to zero or some other predefined low value, the electrodeposition is stopped. By way of example, the following current/voltage/time data typifies the electrodeposition process. Table 1 shows the drop in current for a 20 volt (d.c.) electrodeposition. Voltages used have been from five (5) volts to 150 volts; and times have been from 15 seconds to 20 minutes, depending upon how much organic coating is wanted.

TABLE 1

| Time | Current | Voltage (D.C.) |
|---|---|---|
| 0 | 1210 | 20 |
| :15 | 1028 | 20 |
| :30 | 812 | 20 |
| 1:00 | 411 | 20 |
| 2:00 | 91 | 20 |
| 3:00 | 71 | 20 |

Example 2

Electrodeposition of Polystyrene/Maleic Anhydride

Following the procedure of Example 1, 15 grams of polystyrene/maleic anhydride alternating copolymer which had been hydrolyzed to the diacid, viz., styrene/maleic acid (0.07 moles), was dissolved in 85 mls of water and treated with two molar equivalents of ammonium hydroxide (for the dibasic acid in the copolymer), i.e., 17.4 grams of a 28 percent ammonium hydroxide solution. The electrodeposition was performed as shown in Example 1 and washed with water. The resultant product was examined via SEM and FIG. 8 shows a 10× magnification, while FIG. 9 shows a 1000× magnification. After a caustic (NaOH) wash, the fibers looked as shown in FIG. 10 (a 10× magnification) and FIG. 11 for a 1000× magnification.

Example 3

Electrodeposition of Shell DX-16

This example demonstrates the possibility of performing the electrodeposition in a mixture of organic solvent and aqueous solution. Using a compound known as Shell DX-16 (FIG. 12) (Shell Chemical Co., Emeryville, Calif.) which was dissolved in N-methylpyrrolidone (NMP) to a 50 percent concentration and then made as a 15 percent solution in deionized water (resulting in a mixture of water and NMP) and neutralizing this with 28 percent ammonium hydroxide, an electrodeposition was performed on Thornel 50 fiber at 20 volts. The current dropped from 952 amperes to 65 amperes in 3.5 minutes. Thus, indicating the deposition of a coating as the fiber became coated with an insulator.

Example 4

Electrodeposition of Polyamic Acid

A polyamic acid precursor to a polyimide (PETI-298) (supplied by Eikos Chemical Co., Franklin, Mass.) was synthesized, as shown in the schematic of FIG. 13. This polyamic acid dissolved in NMP as a 50% solution was neutralized with ammonium hydroxide and diluted to a 15% solution in water and electrodeposited onto AS-4 carbon tape at 100 volts. The resultant product was washed with water, dried and pyrolyzed at 1000° C. (under nitrogen) to result in a carbon-carbon composite. This demonstrates the feasibility of obtaining a carbon-carbon composite from an electrodeposited coating.

Example 5

Electrodeposition of Polysiloxane(Amide-Ureide)

An amine-terminated polysiloxane amide is prepared by using a 2 mole ratio of amine-terminated polysiloxane (amine groups at both ends of the polymer) to one (1) mole of the diacidchloride from either succinic acid or maleic acid or any other diacid residue. Subsequently, the resultant amine terminated polysiloxane amide is reacted with a diisocyanate in a ratio of 2 moles of polysiloxane amide (amine-terminated) with one (1) mole of a diisocyanate to form the polysiloxane (amide-ureide)-diamine-terminated. To this is added two moles of either succinic anhydride or maleic anhydride (or any other acid anhydride) to result in a carboxyl-terminated polysiloxane (amide-ureide).

Utilizing the carboxyl-terminated polysiloxane (amide-ureide) and following the procedure of Example 1, 15 grams of the carboxyl-terminated polysiloxane (amide-ureide) is dissolved in 85 mls of deionized water and treated with 28 percent ammonium hydroxide (two moles of $NH_4OH$ to one mole of carboxyl-terminated polysiloxane (amide-ureide)). The electrodeposition is done on an AS-4 carbon cloth in similar fashion as described in Example 1 and when subjected to icing conditions, it was found that the ice can be easily removed. This product is also found to exhibit ice-phobic behavior as did the non-electrodeposited product described in U.S. Pat. No. 6,797,795, Sep. 28, 2004.

Example 6

Electrodeposition of Polyphosphinohydrazide

Modifying the reaction described in U.S. Pat. No. 4,582,932, Apr. 15, 1986, three moles of hydrazine hydrate are added to two moles of dimethylmethylphosphonate (DMMP) to result in an amine terminated polymer. This is subsequently treated with two moles of succinic anhydride to obtain a carboxyl-terminated phosphinohydrazide which is used in the electrodeposition onto the fibrous substrate, as described in Example 1.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A process for forming a resin-fiber composite, comprising the steps of providing an aqueous solution comprising an ionizable moiety, the ionizable moiety selected from the group consisting of polyamic acid, phenyl phosphinic acid, polyisobutylene-alt-maleic acid, polyphosphazene, polymetallophosphazene, polyborazine, phosphonicacidmethylene iminodiacetic acid, polyferrocene, polymetallocene, polysulfone, polyquinoxaline, polyether ether ketone (PEEK), and any combination thereof;

disposing an electrically conductive fibrous substrate within the aqueous solution, wherein the fibrous substrate serves as an anode;

contacting a second conductive body with the aqueous solution, wherein the second conductive body serves as a cathode;

applying an electric potential between the anode and the cathode;

ionizing the ionizable moiety in the aqueous solution;

covalently bonding the ionizable moiety to the fibrous substrate to form a composite fiber;

maintaining the electrodeposition conditions until at least one additional layer of the ionizable moiety is deposited on top of the resin matrix; and impregnating the composite fiber with polyamic acid.

2. The process of claim 1, wherein the electrically conductive fibrous substrate is carbon fiber.

3. The process of claim 1, further comprising the step of curing the deposited resin matrix.

4. The process of claim 1, wherein the aqueous solution contains an organic solvent.

5. A composite structure formed according to the process of claim 1, wherein the composite substrate comprises a fibrous substrate having polyphosphinohydrazide covalently bonded to a surface thereof.

6. The composite structure of claim 5, wherein the structure takes the form of a composite fastener.

7. The composite structure of claim 6, wherein the composite fastener is a bolt or composite rivet.

8. The composite structure of claim 5, wherein the composite is a structural component of an aircraft.

9. The process of claim 1, wherein the ionizable moiety is polyphosphinohydrazide, and wherein the resulting resin-fiber composite has fire retardant properties.

10. A process for forming a resin-fiber composite, comprising the steps of providing an aqueous solution comprising an ionizable moiety, the ionizable moiety selected from the group consisting of polyamic acid, polypyrrole, polyaniline, phenyl phosphinic acid, polyisobutylene-alt-maleic acid, polysiloxane, polyphosphazene, polymetallophosphazene, polyborazine, phosphonicacidmethylene iminodiacetic acid, polyphosphinohydrazide, polyferrocene, polymetallocene, polysulfone, polyquinoxaline, polyether ether ketone (PEEK), and any combination thereof;

disposing an electrically conductive fibrous substrate within the aqueous solution, wherein the fibrous substrate serves as an anode;

contacting a second conductive body with the aqueous solution, wherein the second conductive body serves as a cathode; and, applying an electric potential between the anode and the cathode, thereby causing the ionizable moieties to ionize and to be electrodeposited as a resin matrix upon the fiber surfaces of the fibrous substrate, covalently bonding the ionizable moiety to the fibrous substrate to form a composite fiber;

maintaining the electrodeposition conditions until at least one additional layer of the ionizable moieties are deposited on top of a nanomolecular layer.

11. The process of claim 10 wherein the ionizable moiety is a polysiloxane(amide-ureide) of the formula Ia (Ia)

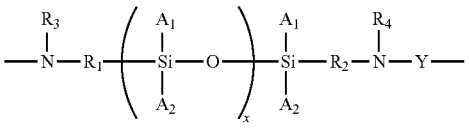

wherein for each repeat unit of the polymer, $R_1$ and $R_2$ are independently selected from the group consisting of $C_1$ to $C_{10}$ alkyls, aryls, and polyaryls; for each repeat unit of the polymer, $R_3$ and $R_4$ are independently selected from the group consisting of hydrogen, $C_1$ to $C_6$ alkyls, aryls, $C_3$ to $C_6$ cycloaliphatics, and $C_3$ to $C_6$ heterocycles; for each repeat unit of the polymer, $A_1$ and $A_2$ are independently selected from the group consisting of hydrogen, $C_1$ to $C_6$ alkyls, aryls, polyaryls, $C_3$ to $C_6$ cycloaliphatics, and $C_3$ to $C_6$ heterocycles; for each repeat unit of the polymer, x is a number from 1 to 1000; for each repeat unit of the polymer, Y is selected from a dicarboxyl residue and a non-linear diisocyanate residue, and wherein the polymer comprises at least one repeat unit where Y is a dicarboxyl residue and at least one repeat unit where Y is a nonlinear diisocyanate residue.

12. The process of claim 10, wherein the electrically conductive fibrous substrate is a carbon fiber.

13. The process of claim 10, wherein electrodeposition conditions are maintained until no substantial void space remains within the fibrous substrate.

14. The process of claim 10, wherein the electrodeposition conditions are discontinued while void spaces remain within the fibrous substrate; and, further comprising the step of subsequently resin impregnating the fibrous substrate by a resin infusion technique.

15. The process of claim 10, further comprising the step of curing the deposited resin matrix.

16. The process of claim 10, wherein the aqueous solution contains an organic solvent.

17. A composite structure formed according to the process of claim 10 wherein the composite structure comprises a fibrous substrate having an ionizable moiety covalently bonded to a surface thereof.

18. The composite structure of claim 17, wherein the structure takes the form of a composite fastener.

19. The composite structure of claim 18, wherein the composite fastener is a bolt or composite rivet.

20. The composite structure of claim 17, wherein the composite is a structural component of an aircraft.

21. The process of claim 10, wherein the ionizable moiety is polyphosphinohydrazide, and wherein the resulting resin-fiber composite has fire retardant properties.

* * * * *